United States Patent [19]

Medwed

[11] Patent Number: 4,521,936

[45] Date of Patent: Jun. 11, 1985

[54] SELF-CLEANING JOINT

[75] Inventor: Peter M. Medwed, Pound Ridge, N.Y.

[73] Assignee: Electrolux Corporation, Stamford, Conn.

[21] Appl. No.: 537,643

[22] Filed: Sep. 30, 1983

[51] Int. Cl.[3] ..... A47L 5/00

[52] U.S. Cl. ..... 15/377; 15/389; 285/7

[58] Field of Search ..... 15/363, 377, 351, 410; 137/238, 240; 285/7

[56] References Cited

U.S. PATENT DOCUMENTS

| | | | |
|---|---|---|---|
| Re. 16,585 | 4/1927 | Hoover . | |
| 1,552,713 | 9/1925 | Leary . | |
| 1,849,515 | 3/1932 | Ell . | |
| 2,202,999 | 6/1940 | Smellie . | |
| 2,212,942 | 8/1940 | Karlström . | |
| 2,216,934 | 10/1940 | Barrner . | |
| 2,295,354 | 9/1942 | Peterson . | |
| 2,333,409 | 11/1943 | Brown, Jr. . | |
| 2,371,767 | 3/1945 | Lofgren . | |
| 2,432,670 | 12/1947 | Lampe . | |
| 2,659,099 | 11/1953 | Ott | 137/238 X |
| 3,525,352 | 8/1970 | Jensen | 137/238 |
| 3,943,957 | 3/1976 | Kirkland | 137/238 |
| 4,167,801 | 9/1979 | Erbor et al. | 15/377 X |
| 4,199,839 | 4/1980 | Martinec | 15/377 X |
| 4,447,930 | 5/1984 | Glenn et al. | 15/377 X |

FOREIGN PATENT DOCUMENTS

| | | | |
|---|---|---|---|
| 42230 | 11/1965 | Fed. Rep. of Germany | 15/351 |

*Primary Examiner*—Philip R. Coe
*Assistant Examiner*—Frankie L. Stinson
*Attorney, Agent, or Firm*—Jeffrey H. Ingerman

[57] ABSTRACT

A self-cleaning joint is disclosed. The joint is disposed in an air flow passage, such as that of a vacuum cleaner power nozzle, and allows an element attached thereto, such as a vacuum cleaner hose to which it is connected, to be pivoted between first and second positions. The joint includes a chamber and a tubular member having a first portion pivotably disposed in the chamber and a second portion protruding from the chamber. To prevent abrasion of the joint caused by the accumulation of abrasive particles, the inner walls of the chamber are provided with grooves where any dust which penetrates the joint can collect. The grooves are positioned so that they are cleaned periodically by the flow of air in the passage.

10 Claims, 3 Drawing Figures

SELF-CLEANING JOINT

BACKGROUND OF THE INVENTION

This invention relates to joints in air passages through which flows matter capable of abrading the joints, and more particularly to a vacuum cleaner power nozzle having an articulated joint in the air passage between the power nozzle body and the hose coupling thereof.

In canister-type vacuum cleaners, the suction motor unit and the dust-collecting bag are housed in a body which rests movably on the floor. A flexible hose is connected at one end to an orifice in the body, and any of various cleaning attachments can be connected to the other end of the hose. A rigid section, commonly referred to as a "wand," can be interposed between the end of the flexible hose and the attachment. As used herein, the term "hose" includes both the flexible and the rigid portions of the hose.

One type of cleaning attachment which is provided for use with canister-type vacuum cleaners is the power nozzle. This nozzle, which is designed primarily for use on rugs and carpets, has a separate motor within its body which drives a rotary device, such as a brush or beater, for agitating the carpet surface to loosen dirt and for separating matted-down fibers. The brush is disposed in the air passage through which the flow of suction air removes the loosened dirt.

This air flow passage terminates in a coupling to which the hose is connected. In order for the user to be able to maneuver the nozzle easily, an articulated joint is usually provided in the air flow passage at a point between the body and the coupling, so that the angle between the hose and the floor at the coupling is freely variable.

An early joint of that type included a fork hinged to the rear of the body. The coupling depended from the fork. A flexible hose connected the air flow passage in the body to the coupling, passing between the legs of the fork. The fork and the coupling could thus be pivoted in a vertical plane without disrupting the air flow passage.

A more recent joint of that type includes a chamber having walls defined by the body of the nozzle, and a tubular member having a portion disposed within the chamber. A second portion of the tubular member extends from an opening of the chamber and terminates in the coupling. The portion of the tubular member disposed within the chamber is movable about a horizontal axis extending from one side of the chamber to the other, so that the tubular member can be pivoted in a vertical plane. An opening in the portion of the tubular member within the chamber is configured so that the air passage remains open regardless of the pivot angle, yet the opening is never exposed outside the chamber.

In that joint, dust and dirt in the air flow can enter between the outer walls of the tubular member and the inner walls of the chamber. In addition, portions of the outer walls of the tubular member are exposed to the flow of dust-laden air within the chamber. Additional dust enters the area between the outer walls of the tubular member and the inner walls of the chamber after it is deposited on the outer walls of the tubular member which is then pivoted so that these walls come in contact with the inner walls of the chamber. If such a joint were made of metal, this accumulation of dust may not pose any problems, as metal is harder than dust. However, such joints are now commonly made of plastic Frequently, dust and dirt particles are harder than the plastic of the joint. As a result, dust trapped between the outer walls of the tubular member and the inner walls of the chamber acts as an abrasive, damaging the plastic joint as it is repeatedly pivoted.

The need exists for a means to prevent abrasion damage caused by dust in a plastic articulated joint, in the air flow passage of a vacuum cleaner power nozzle, of the type having a tubular member disposed within a chamber defined by the nozzle body.

SUMMARY OF THE INVENTION

In accordance with the present invention a means is provided for preventing abrasion damage caused by dust in a plastic articulated joint, in the air flow passage of a vacuum cleaner power nozzle, of the type having a tubular member disposed within a chamber defined by the nozzle body.

The power nozzle comprises a body having a passage for the flow of air, means within the passage, supported by the body, for agitating a surface to be cleaned, and power means for driving the surface agitation means. A joint in the air flow passage of the body comprises a chamber whose inner and outer walls are defined by the body and a tubular member having outer walls and having a first portion disposed within the chamber which is movable about an axis in the chamber between service and storage positions, and a second portion extending from the chamber and having a coupling for attaching a vacuum cleaner hose. The chamber has a recess in its inner walls for collecting any dust which enters between the outer wall of the first portion of the tubular member and the inner wall of the chamber. The recess is positioned so that accumulated dust is removed periodically by the flow of air through the passage.

BRIEF DESCRIPTION OF THE DRAWINGS

The above and other advantages of the present invention will be more completely understood after consideration of the following detailed description of the preferred embodiment, taken together with the accompanying drawings, in which like parts are indicated by like reference characters throughout, and in which.

DETAILED DESCRIPTION OF THE PREFERRED EMBODIMENT

Figure 1:
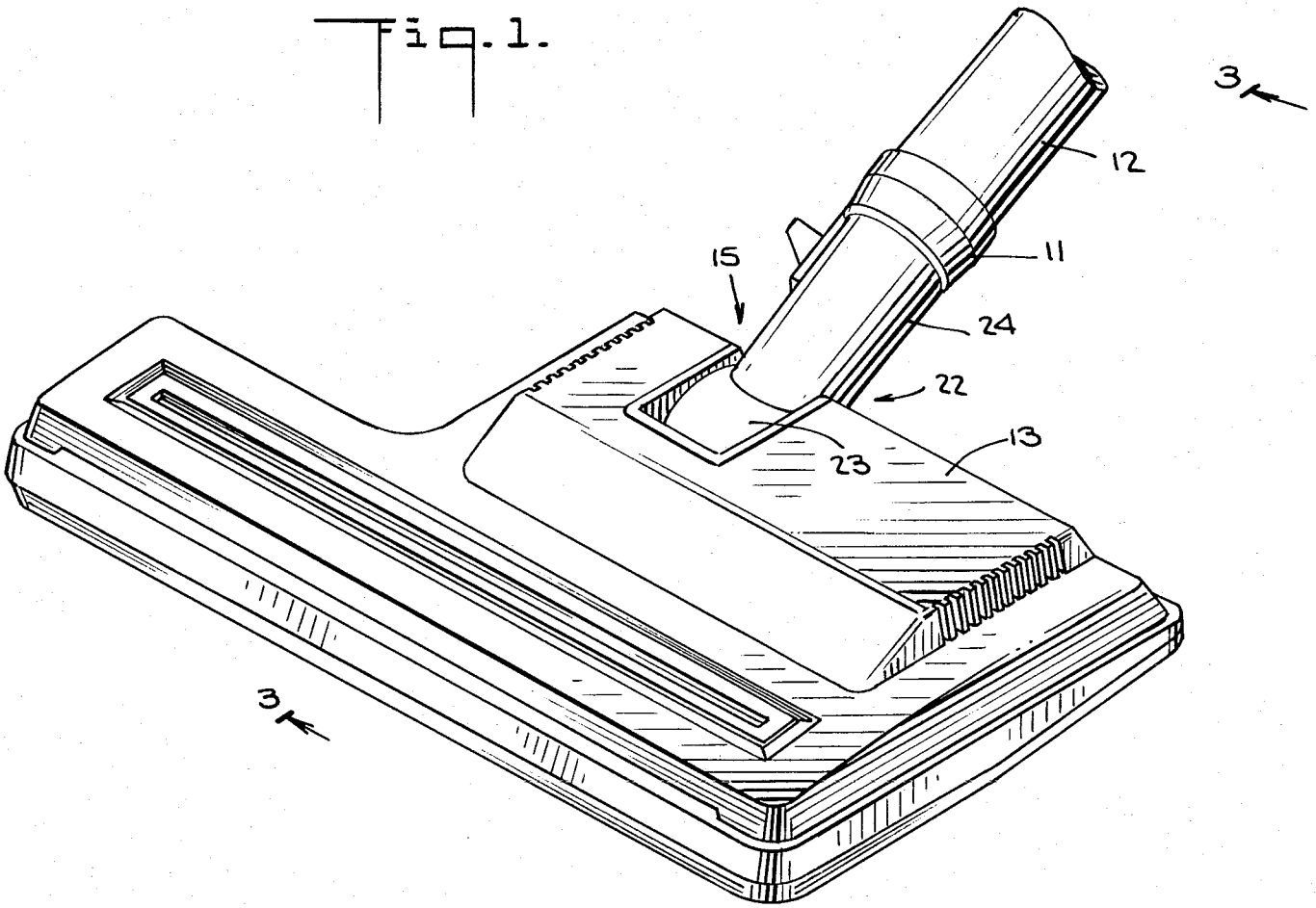
FIG. 1 is a perspective view of a vacuum cleaner power nozzle according to the present invention.
Figure 2:
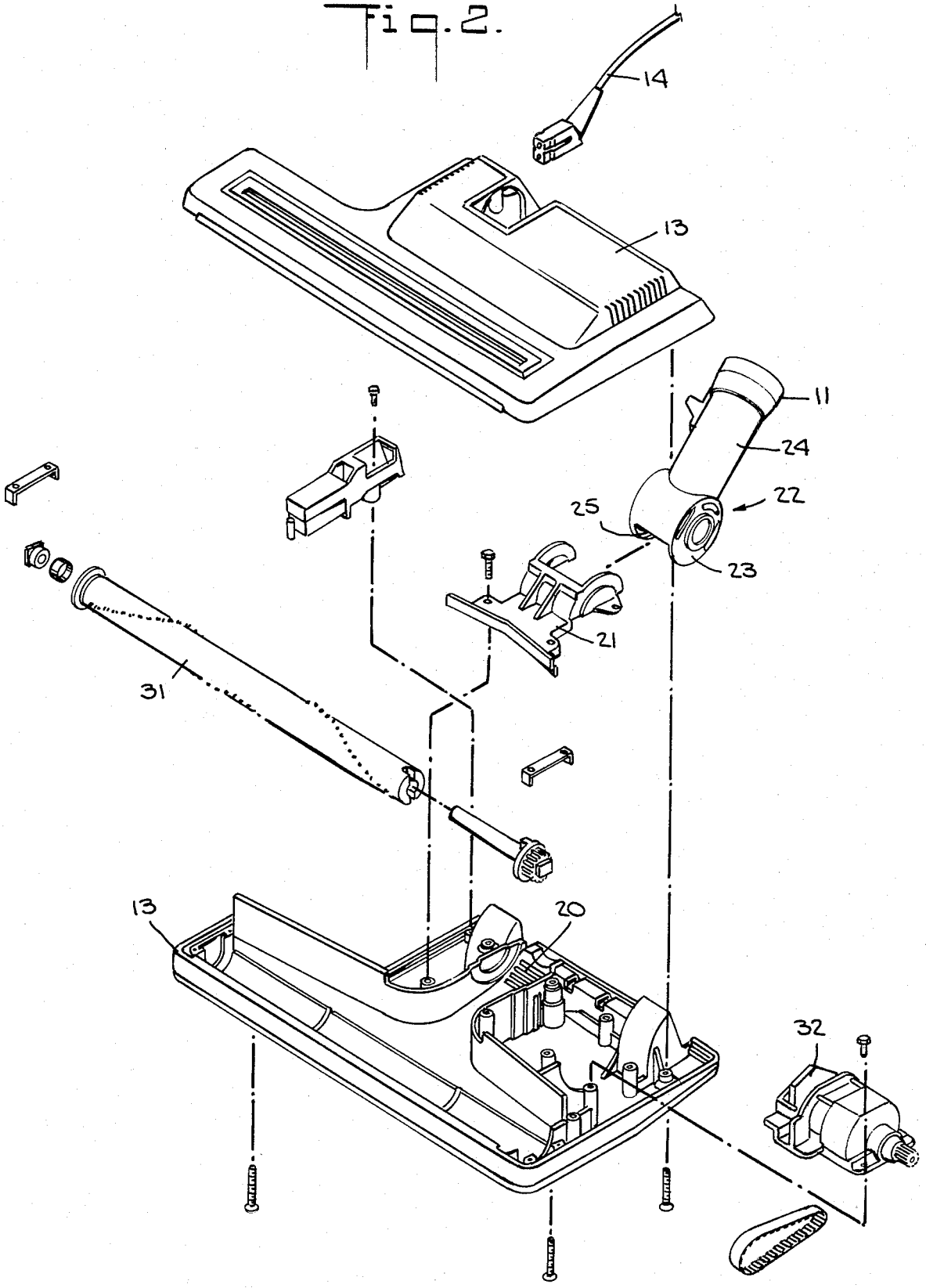
FIG. 2 is an exploded perspective view of the joint in the power nozzle of FIG. 1.
Figure 3:
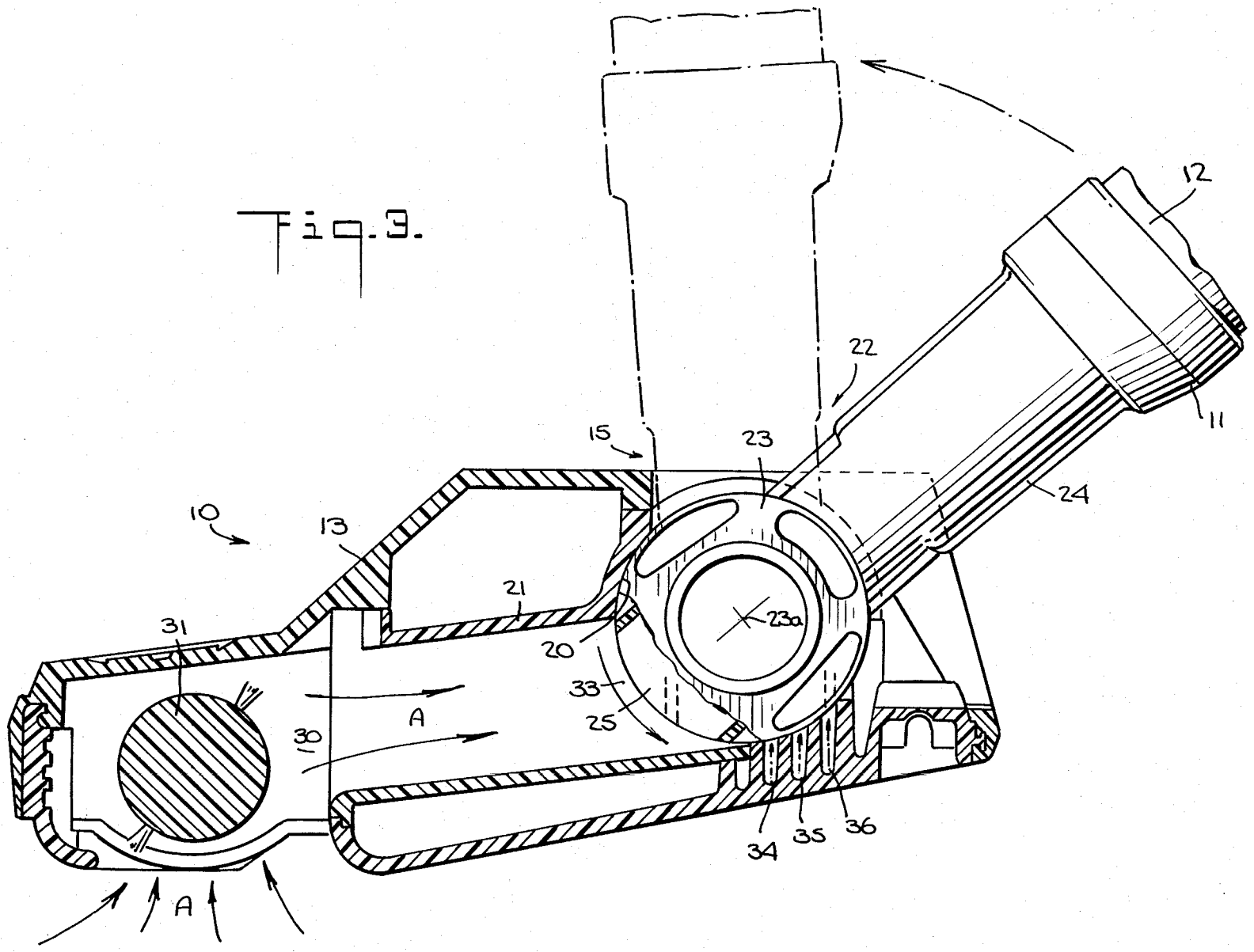
FIG. 3 is a cross-sectional view of the joint in the power nozzle of FIG. 1, taken from line 3—3 of FIG. 1.

A vacuum cleaner power nozzle 10 according to the present invention is shown in FIGS. 1 through 3. The nozzle is meant for use with a vacuum cleaner (not shown) which provides a flow of suction air through a suction hose (not shown) which is connected to the nozzle at coupling 11. Wand 12, shown connected to coupling 11, is an extension of the hose. The nozzle has a body 13 which has an air flow passage 30 through which the flow of suction air (indicated by the arrows A in FIG. 3) removes dust and dirt from the surface (not shown) being cleaned. A surface agitation device, such as rotary brush 31, supported by body 13 within passage 30, helps loosen the dirt from the surface. Agitation means 31 is powered by electric motor 32. The power to run electric motor 32 is conducted to nozzle 10 from the vacuum cleaner by nozzle power cord 14 which lies along or is molded in the suction hose.

It is desirable to be able to pivot wand 12 in the vertical plane of FIG. 3 from a fully upright position (indicated in phantom), mainly used for storage of the power nozzle, through a continuous range of positions approaching to a horizontal position, in which positions wand 12 is held according to convenience during use of the nozzle.

Joint 15 is provided in air flow passage 30 to allow such pivoting of wand 12 without disrupting the flow of suction air. Joint 15 includes a chamber 20 whose inner and outer walls are formed by nozzle body 13 and cover plate 21. Hollow tubular member 22 makes up the remainder of joint 15. Hollow first portion 23 of tubular member 22 is received in chamber 20. Hollow second portion 24 of tubular member 22 protrudes from the chamber and has an opening at coupling 11 at the end thereof. Chamber 20 is open to air flow passage 30 at opening 33. First portion 23 has an opening 25 for registration with opening 33. First portion 23 can rotate about a horizontal side-to-side axis 23*a* in chamber 20 to allow the desired pivoting of second portion 24 and wand 12. Openings 25 and 33 are placed so that they remain in at least partial registration regardless of the position of tubular member 22. This allows air flow passage 30 to remain open between the surface to be cleaned and coupling 11 at all times.

In the embodiment illustrated, tubular member 22 is T-shaped with the cross bar of the T-shaped member serving as first portion 23 and the upright serving as second portion 24. The crossbar is closed at both ends.

Dust which impinges on the portions of the outer wall of first portion 23 that are exposed to the air flow during use can be forced between the outer wall of first portion 23 and the inner wall of chamber 20 by pivoting of tubular member 22. In the embodiment shown the parts of joint 15 are made of plastic. Because dust is frequently harder than plastic, the dust which penetrates between the walls of first portion 23 and chamber 20 can scratch and grind the plastic. This can cause leakage of air around the joint and can also make pivoting of the joint difficult.

To alleviate the problems caused by the accumulation of dust between the outer walls of first portion 23 and the inner walls of chamber 20, one or more recesses 34, 35, 36 are provided in the inner wall of the chamber 20. As shown in FIGS. 2 and 3, the recesses are narrow elongated grooves parallel to axis 23*a*. Any dust which penetrates to the space between first portion 23 and chamber 20 will tend to accumulate in grooves 34, 35, 36. In particular, the pivoting of joint 15, which moves the dust into the space between part 23 and the lower wall of chamber 20, also sweeps the dust toward grooves 34, 35, 36. The grooves are placed so that as wand 12 is pivoted from a fully horizontal position to a fully upright position, grooves 34, 35, 36 are successively exposed to the flow of suction air, which removes the accumulated dust, thus cleaning the joint through normal use.

Although it is within the scope of this invention to have only one groove, it is preferable to have several grooves, as shown.

Under normal conditions of use, wand 12 is held between the horizontal and approximately a 45° angle, rising as the nozzle is drawn toward the user and falling as it is pushed away. Only when it is necessary for the user to pull the nozzle very close, or just before storage of the nozzle, does wand 12 rise to larger angles. Therefore, the sweeping action that causes dust to be brought into joint 15 will bring the greatest amount of dust to the area of groove 34. For the same reasons, groove 34 will be the groove most frequently exposed to the air flow. Groove 35 will receive less dust and be exposed to the air less often, and groove 36 will receive the least dust and be exposed least often. Groove 34, which is the fastest filled, is also cleaned most frequently. In use, it is desirable to move wand 12 to the full upright "storage" position before turning off the suction motor of the vacuum cleaner, in order to clean out grooves 35 and 36.

Thus, a vacuum cleaner power nozzle is provided having a joint in which the abrasion damage caused by dust and dirt that penetrates the joint is reduced, and in which the dust is removed through normal use of the power nozzle. One skilled in the art will recognize that the invention disclosed herein can be practiced in other than the embodiment described, and the invention is not limited by that embodiment, but only by the claims which follow.

What is claimed is:

1. A vacuum cleaner power nozzle, comprising:

a body having a passage for the flow of air therethrough;

means within said passage, supported by said body, for agitating a surface to be cleaned; and power means for driving said surface agitating means;

said body further comprising an articulated joint in said passage, said joint comprising:

a chamber having walls defined by said body, and a tubular member having outer walls and having a first portion disposed within said chamber and rotatable about an axis in said chamber between first and second positions, and a second portion extending from said chamber and having a coupling for attaching a vacuum cleaner hose, said chamber having a first recess in said wall of said chamber for collecting dust which enters between said outer wall of said first portion and said wall of said chamber, said recess being positioned such that dust collected therein is removed by the flow of air through said passage when said first portion is in said second position.

2. The power nozzle of claim 1, wherein said walls of said chamber and said walls of said tubular member are made of plastic.

3. The power nozzle of claim 1, further comprising at least one additional recess in said wall of said chamber of the same type as said first recess, said recesses being positioned such that dust collected therein is removed from an increasing number of said recesses by the flow of air as said first portion is moved from said first position toward said second position.

4. The power nozzle of claim 1, wherein said recess is a narrow elongated groove substantially coplanar with said axis.

5. The power nozzle of claim 1, wherein said chamber is cylindrical and said tubular member is T-shaped, said first portion comprising the crossbar of said T-shaped member and said second portion comprising the upright of said T-shaped member.

6. An articulated joint in a dust and air flow passage, comprising:

a chamber having walls defined by a first segment of said passage; and a tubular member having outer walls and having a first portion disposed in said chamber and rotatable in said chamber about an axis between first and second positions, and a second portion extending from said chamber and coupled to a second segment of said passage, such that the relative orientation of said first and second segments of said passage vary as said first portion is rotated between said first and second positions;

said chamber having a first recess in said wall of said chamber for collecting dust which enters between said outer wall of said first portion and said wall of said chamber, said recess being positioned such that dust collected therein is removed by the flow of air through the passage when said first portion is in said second position.

7. The joint of claim 6, wherein said walls of said chamber and said walls of said tubular member are made of plastic.

8. The joint of claim 6, further comprising at least one additional recess in said wall of said chamber, said recesses being positioned such that dust collected therein is removed from an increasing number of said recesses by the flow of air as said first portion is moved from said first position toward said second position.

9. The joint of claim 6, wherein said recess is a narrow elongated groove substantially coplanar with said axis.

10. The joint of claim 6, wherein said chamber is cylindrical and said tubular member is T-shaped, said first portion comprising the crossbar of said T-shaped member and said second portion comprising the upright of said T-shaped member.

* * * * *